US010495345B2

(12) United States Patent
Muehleip

(10) Patent No.: US 10,495,345 B2
(45) Date of Patent: Dec. 3, 2019

(54) TANK CLEANER

(71) Applicant: Craig Muehleip, Rigby, ID (US)

(72) Inventor: Craig Muehleip, Rigby, ID (US)

(73) Assignee: MUEHLEIP INVENTIONS, LLC, Idaho Falls, ID (US)

( * ) Notice: Subject to any disclaimer, the term of this patent is extended or adjusted under 35 U.S.C. 154(b) by 367 days.

(21) Appl. No.: 15/396,564

(22) Filed: Dec. 31, 2016

(65) Prior Publication Data

US 2018/0187922 A1 Jul. 5, 2018

(51) Int. Cl.

| | |
|---|---|
| ***F24H 9/00*** | (2006.01) |
| ***B08B 9/087*** | (2006.01) |
| ***A46B 13/02*** | (2006.01) |
| ***A46B 11/06*** | (2006.01) |
| ***B08B 9/093*** | (2006.01) |

(52) U.S. Cl.

CPC ..... *F24H 9/0042* (2013.01); *A46B 11/06* (2013.01); *A46B 13/02* (2013.01); *B08B 9/087* (2013.01); *B08B 9/0933* (2013.01); *A46B 2200/3006* (2013.01)

(58) Field of Classification Search

CPC ..... F24H 9/0042; F24H 9/16; A46B 11/06; A46B 11/1302; A46B 13/02; B08B 9/087; B08B 9/0933

See application file for complete search history.

(56) References Cited

U.S. PATENT DOCUMENTS

| | | | | | |
|---|---|---|---|---|---|
| 2,450,486 | A * | 10/1948 | Perry | E03C 1/302 | 15/104.095 |
| 4,317,247 | A * | 3/1982 | Levine | E03F 9/005 | 15/104.33 |
| 4,376,321 | A * | 3/1983 | Dudley | E03F 9/002 | 15/104.095 |
| 4,512,289 | A * | 4/1985 | Collins | F24H 9/124 | 122/159 |
| 4,790,289 | A * | 12/1988 | Barrett | F24H 1/18 | 122/17.1 |
| 6,145,808 | A * | 11/2000 | Hickman | F24H 9/16 | 137/269 |
| 2013/0048028 | A1 | 2/2013 | Morin | | |

* cited by examiner

*Primary Examiner* — Shay Karls
(74) *Attorney, Agent, or Firm* — Thorpe North & Western, LLP

(57) ABSTRACT

A tank cleaning tool is disclosed for cleaning sediments and debris out of a tank. The tool has housing with an inlet end to connect to drain hole of the tank, and an outlet end to discharge slurry out of the tool. An agitator is present at the inlet end, and can be inserted through drain hole of the tank to agitate sediments and debris inside the tank to pull sediments and debris into the inlet end when the agitator is spun. The tool may preferably include an auger connected to lower end of said agitator where the auger grinds sediments and debris inside the housing to form slurry. The tool may also include a grinding chamber between said outlet end and said inlet end to grind the sediments and debris inside said housing to form slurry. A drill can be used to rotate the auger and the agitator.

20 Claims, 3 Drawing Sheets

TANK CLEANER

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION

(1) Field of Invention

The present invention generally relates to a tank cleaning tool. More particularly, the present invention relates to "a tool for efficiently cleaning tank such as tank of a water heater".

(2) Background of Invention

Tank water heaters due to prolonged use tend to develop mineral deposits due to hard water. These mineral deposit buildups also affect the function of the tank water heater and result in shortened operational life of the tank water heater. These mineral deposits also create sediments and debris in the tank which can clog the drain hole of the tank water heater. It is a cumbersome task to unclog the drain hole and to remove the sediments and debris from the tank water heater. Easiest way to clean the tank is through use of chemicals, but this method may take several treatments over a period of days or week. Some people also insert screwdrivers or similar tools through the drain hole to break up the clog. Alternatively, tank must be drained, the heating elements have to be removed and cleaned with a shop vacuum which has a small hose taped on it. This method may take up hours for the clogging to be resolved. Also, there is no good method of cleaning gas heaters. Some tank cleaning methods and tool have also been developed, wherein each of the following patents are herein incorporated by reference for their supportive teachings, for example:

U.S. Pat. No. 4,512,289 A issued to State Industries, Inc. on 1985, Apr. 23, discloses a water heater having a magnetic device connected to a water heater causing sediments to build upon each other, and also discloses an agitator assembly present at the bottom of the water heater for creating a stirring action at the bottom of the tank to drive out the sediments from the water heater.

U.S. Pat. No. 4,790,289 A issued to A. O. Smith Corporation on 1988, Dec. 13, discloses an agitating mechanism to prevent sediment buildup in a gas fired water heater.

U.S. patent application Ser. No. 13/220,573 discusses a system kit including an introduction-extraction tube, a water heater wrench, and an amount of calcium cleaning solution for extracting debris from the reservoir of a water heater.

However, these systems and methods are costly and may not work with regular tank water heater. Hence, there is a need for an inexpensive system and method which can work with a regular tank water heater and other tanks needing cleaning of sediments. The system and method should be easy to use. Further, it is required the system and method cleans the debris and sediments faster from the tank water heater. Also, the system should be portable and easy to store. It is an aspect of the invention to overcome or alleviate a problem of the prior art. This permits the use of the present invention which enhance the prior art of the system and method of cleaning tank water heater.

BRIEF SUMMARY OF THE INVENTION

In view of the foregoing, one aspect of the various disclosed embodiments in the present invention is to provide a tank cleaning tool.

Preferably the tank cleaning tool addresses, or at least ameliorates one or more of the problems described above. To this end, the present invention related to a tank cleaning tool, with some unique aspects is disclosed.

Accordingly, it is a primary object of the present invention to provide a tool for efficiently cleaning tank water heater. The tool includes an agitator at the inlet end of the tool and a discharge hose at the outlet end of the tool. The inlet end of the tool is connected to the drain hose of the tank water heater to insert the agitator inside the drain hose and stir up the debris and sediments present at the bottom of the tank water heater. The stirred up debris and sediments are drawn along with water in the inlet end of the tool where slurry of water and debris is created. The slurry is then discharged from the outlet end via discharge hose.

It is another object of the present invention that the tank cleaning tool can be connected to different types of tank through their drain hose for an effective cleaning. The tank may be tank of an electric water heater, gas water heater, commercial water heater, boilers, or any tank that must be cleaned of sludge, sediment, vegetative matter, or any type of debris.

It is yet another object of the present invention that the tank cleaning tool is easy to use.

It is yet another object of the present invention that the tank cleaning tool can be automatically used.

It is still another object of the present invention that the tank cleaning tool is easily portable.

Other objects of the present invention will become apparent from time to time throughout the specification as hereinafter related.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty which characterize the invention, are pointed out with particularity in the disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

To further clarify various aspects of some example embodiments of the present invention, a more particular description of the invention will be rendered by reference to specific embodiments thereof which are illustrated in the appended drawing. It is appreciated that the drawing depicts only illustrated embodiments of the invention and are therefore not to be considered limiting of its scope. The invention will be described and explained with additional specificity and detail through the use of the accompanying drawing in which.

DETAIL DESCRIPTION OF THE INVENTION

Figure 1:
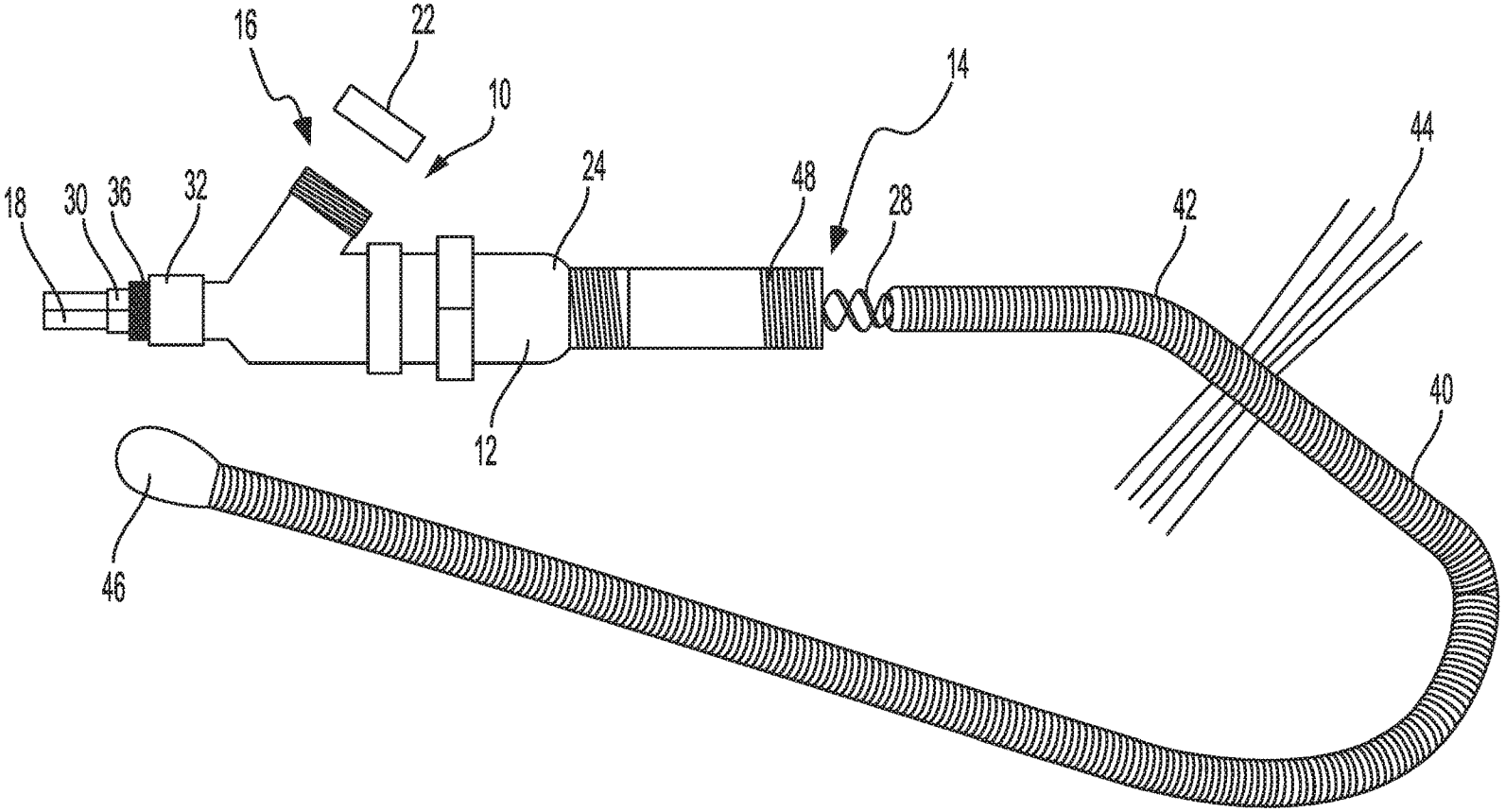
FIGS. 1-3 show-perspective, isometric and exploded views of a tank cleaning tool.
Figure 2:
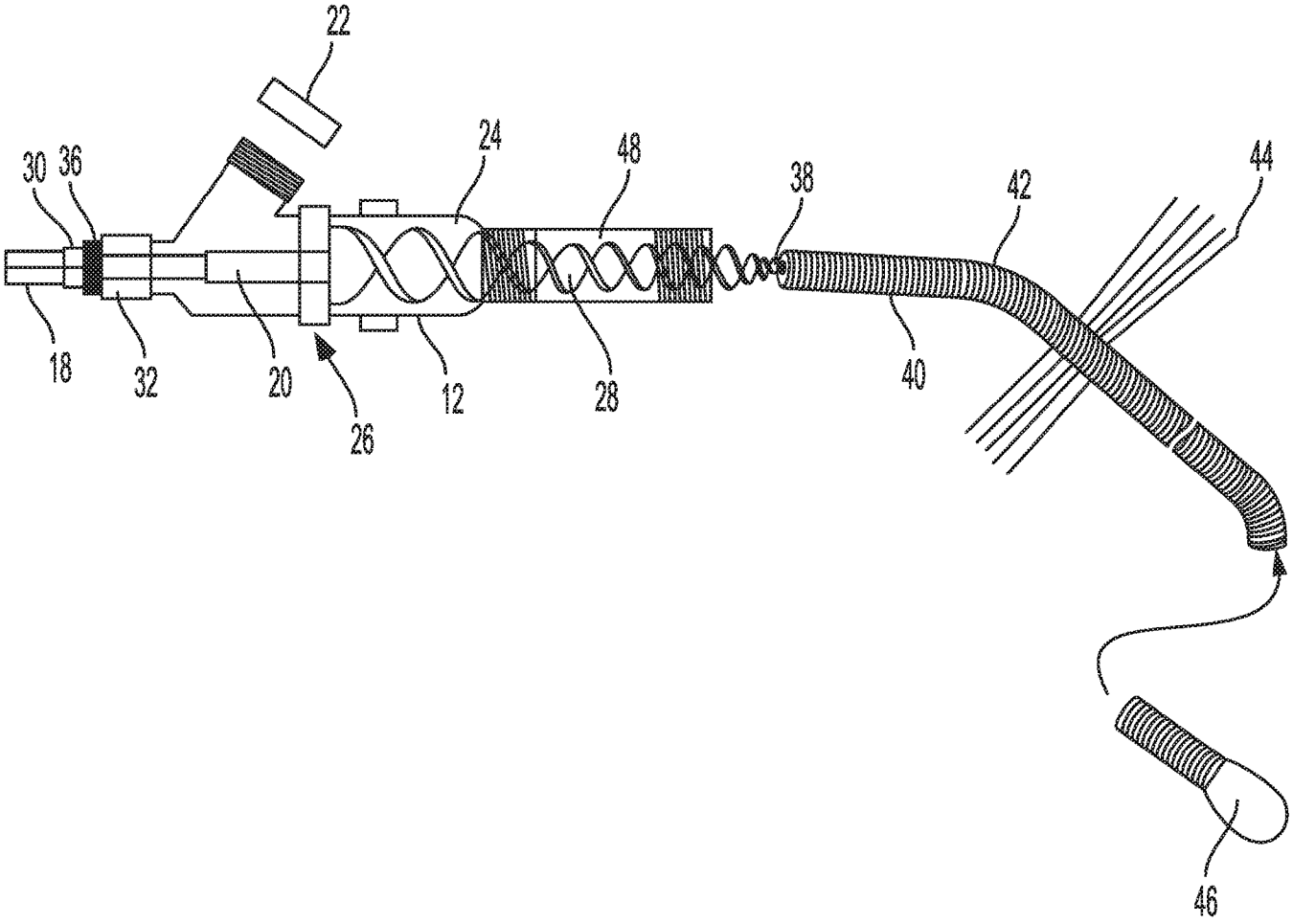
Figure 3:
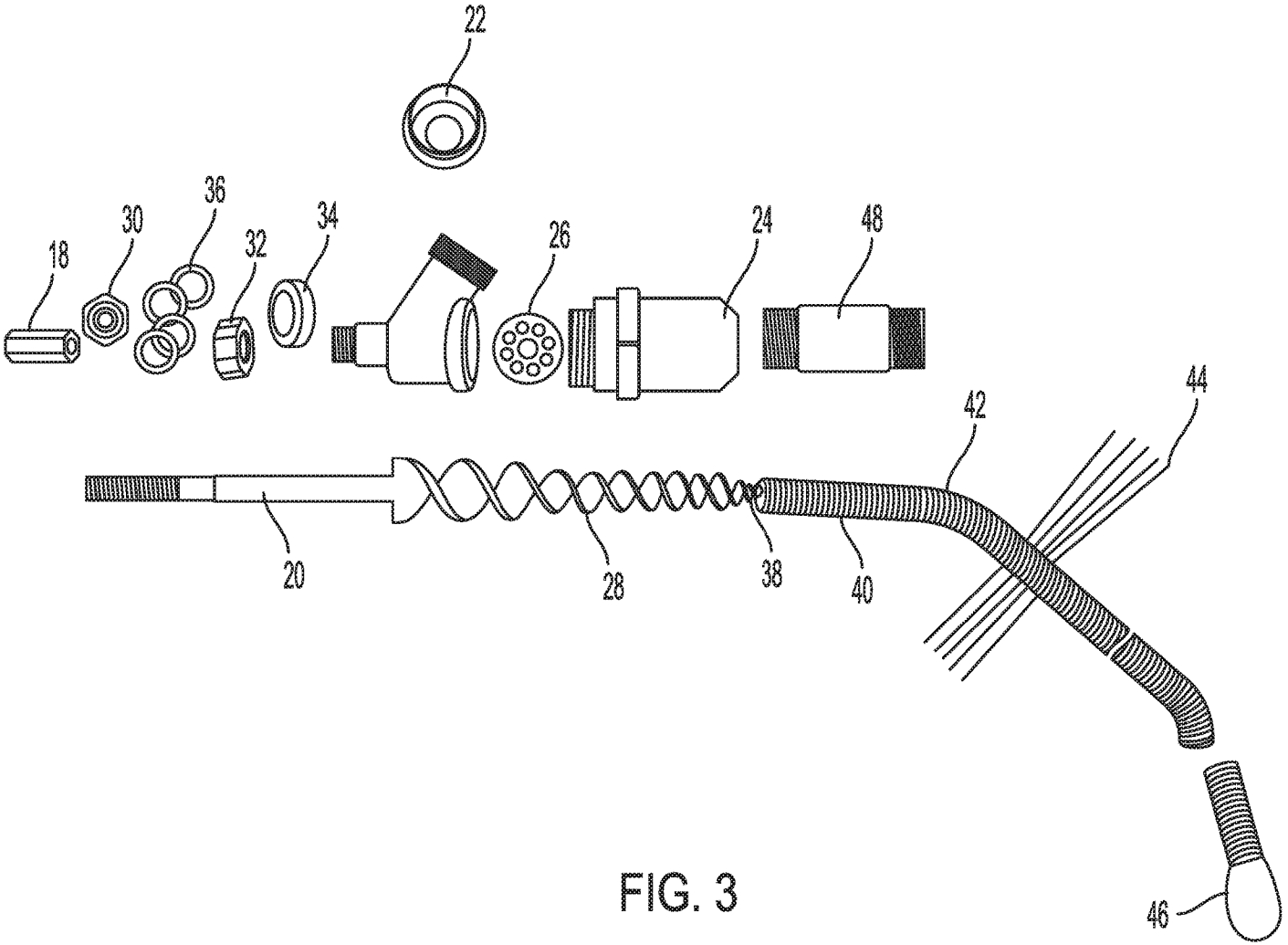

The following detailed description of the present invention is enabling teaching of the invention and its best, currently known embodiment. Those skilled in the art can understand that many changes can be made in the embodiments described, while still obtaining beneficial results of the present invention. It will also be apparent that some of the desired benefits of the present invention can be obtained by selecting some of the features of the invention while not utilizing other features. Accordingly, those working in the relevant art will recognize that many adaptations and modification to the present invention can be made and may be desired in certain circumstances, and are part of the present invention. Thus, the following description is provided as illustrative of the principle of the present invention.

Embodiments of the present invention provide a tank cleaning tool. Accordingly, the specific embodiments discussed herein are merely illustrative of specific manners in which to make and use this invention, and are not intended to represent an exhaustive list of all possible structure and processes of the present invention.

Embodiments of the tank cleaning tool are shown in the FIGURES, and discussed below. While the structure and processes have been described with a certain degree of particularity, it is to be noted that many modifications may be made in the details of the structure and processes without departing from the spirit and scope of this disclosure. It is understood that the structure and processes are not limited to the embodiments set forth herein for purposes of exemplification.

Aspects of the present inventive subject matter are described with reference to the FIGURES.

The present invention provides a tank cleaning tool for cleaning sediments and debris out of a tank such as a tank of a water heater. The tool comprises housing with an inlet end and an outlet end, an agitator present at the inlet end and a shaft adaptor for connecting the tool to a drill near the outlet end. A discharge hose may be connected at the outlet end of the tool. The inlet end of the tool is adapted to be connected to the drain hole of the tank. The agitator can be inserted inside the drain hole to reach the bottom of the tank. The agitator has to be thin enough to fit in the drain hole. The agitator has a drain cleaning snake with kink on it. The agitator is preferably made up of half inch drain cleaning snake. The agitator is adapted to be spun to stir up the debris along with the water in the tank and creates as much turbulence as possible so as to draw up the debris and the water into the inlet end of the tool. The kink helps the agitator to spin violently. The agitator is made of material which is stiff enough to be pushed through the debris and which is flexible enough to bounce across and around objects and curved tank bottom. The agitator may additionally include plurality of brush bristle. The brush bristles increase turbulence when the agitator spins at the bottom of the tank. The agitator may additionally have inserts to break up or cut debris to loosen them. The inserts may preferably be weights, brushes and cutters. The inserts may be connected to the upper end of the agitator with help of adaptors. The agitator thereby functions to remove the maximum amount of the waste out of the tank to clean the tank. The length of the agitator could change depending on the tank size and shape. The debris and water drawn inside the tool through the inlet end form slurry inside the housing which is then discharged from the discharge hose present at the outlet end of the tool. The outlet end of the tool may have a cap which can be opened to remove the slurry. Alternatively, the outlet end has a valve to regulate the discharge of the slurry out of the tool. The inlet end may preferably include a pipe nipple which connects the inlet end of the tool to the drain hole of the tank. The pipe nipple can be left in the tank and capped.

In a preferred embodiment of the present invention, the tool also includes an auger connected to the bottom end of the agitator. The drain cleaning snake of the agitator is threaded onto the upper end of the auger. The lower end of the auger is connected to a shaft which is connected to a rotating mechanism which rotates the auger. The rotating mechanism may preferably be a drill. The rotating auger causes spinning of the agitator. The auger pulls the water flow carrying the debris into the inlet end of the tool. The rotating auger grinds up the debris and pulls it through the tool to the outlet end for discharge. The auger preferably includes a cutting head for effective breakdown of the debris. The grinding of the debris prevents the debris from plugging up the discharge hose while they exit from the outlet end of the tool.

In another preferred embodiment of the present invention, the tool also includes a grinder connected to the lower end of the auger. The grinder chamber may preferably be large sized to allow more water to flow through the tool for effective cleaning of the tank. The tank cleaning tool may have large discharge hose to allow easy discharge of larger sized debris passing through the grinding chamber. Alternatively the tool may have a smaller discharge hose and a grinder with a grinding disk. The grinding disk is a flat disk perforated with small holes. The grinding disk is seated in the housing of the tool upstream from the outlet end with the connection for discharge hose. In case, the tool includes an auger with a cutting edge, the cutting edge on the auger sweeps over this disk grinding up debris to smaller size and forcing it through the holes in the grinding disk for easy discharge through the smaller discharge hose. Alternatively, the tool may include an auger with a flat paddle in place of a cutting head. The flat paddle sweeps the grinding disk. The flat paddle sufficiently functions to pass the slurry through the grinding disk in case the tank cleaning tool is used for cleaning tank such as of a water heater. The flat paddle could also be slotted to sweep over cutting teeth protruding inside the grinding chamber for effective grinding of the debris. The grinding chamber may be made up of plastic or metal. The grinding chamber is preferably 1.5 inches long and 1 inch in diameter.

In another preferred embodiment of the present invention, the tool includes a shaft with its upper end connected to the bottom end of the agitator. The shaft is preferably a straight shaft or bent shaft. When a rotating mechanism spins the agitator, the shaft rotates off the center or wobbles around in the tool as the shaft is spun from the jerky action of the agitator. This motion of the shaft busts up the debris and prevents plugging at the tool entrance while the debris is forced through the tool by the flow of water.

Referring to FIG. 1 showing a preferred embodiment of the present invention, the tool 10 includes a housing 12 with an inlet end 14 and an outlet end 16. A shaft adaptor 18 is present near the outlet end 16 and is threaded onto a shaft 20. The shaft adaptor 18 is hexagonal shaped and is adapted to connect the tool 10 to a drill by tightening the chuck of the drill to the shaft adaptor 18. Different shaft adaptors may be provided for a ½ inch drill or for a ⅜ inch drill. The outlet end 16 of the tool 10 has threads for connecting a discharge hose or a hose cap 22 to 10 the outlet end 16. The shaft 20 passes through a grinding chamber 24 containing a grinding disk 26 and is connected to the lower end of an auger 28 for rotating the auger 28 when the drill is turned on. A tension nut 30 is threaded onto the shaft 20 to provide an anchor that prevents the auger 28 from moving forward in the tool 10 and holds the lower end of the auger 28 against the grinding disk 26 thereby adjusting the tension between the cutting edge of the auger 28 and the grinding disk 26. A compression nut 32 is threaded on the housing 12 along with a rubber washer 34, so as to be tightened down or loosen up to stop a leak, if any and make a seal around the spinning shaft 20. Spacers or spring 36 are provided between the tension nut 30 and the compression nut 32 where they ride on the shaft 20 to fill the gap and produce tension between the auger 28 and the grinding disk 26. The grinding disk 26 is a large washer with small holes drilled into it. The grinding disk 26 is positioned into the valve body and held there by friction and cutting edge of the auger 28. The upper end of the auger 28 includes an adaptor 38 for agitator 40 which connects the upper end of the auger 28 to the lower end of the agitator 40. The adaptor 38 for the agitator 40 can be welded onto the upper end of the auger 28 or can be casted with the auger 28 as one piece. The agitator 40 includes kinks 42, brush bristles 44, and inserts 46. The inlet end 14 of the tool 10 includes a pipe nipple 48 to connect the tool 10 to the drain hole of the water heater.

The pipe nipple 48 is preferably 2.5 inch long and ¾ inch wide. The pipe nipple 48 may also be removed from the inlet end 14 of the tool 10.

For use, the power to the water heater is turned off. The water supply to the water heater is also turned off. The tank is vented by opening drain faucet or pressure relief valve to relieve the pressure. The tank is unvented to prevent air from getting in. The drain valve on the tank is removed. The inlet end of the tool and the pipe nipple is screwed in the drain hose of the water heater. The water supply to the tank is turned on. The tool is spun clock wise with drill until the tank is clean while the slurry is discharged from the discharge hose present at the outlet end of the tool. The process may take up to 10 to 15 minutes. The water supply to the tank is turned off. The discharge hose may be removed from the outlet end of the tool. The cap can be installed at the outlet end. The tool can be left connected to the drain hose of the tank for future use. Alternatively, the tool can be unscrewed from the pipe nipple. The pipe nipple can be capped off.

In another preferred embodiment of the present invention, the tank cleaning tool has a motor and a timer for automated use. The speed and spin of the tool according to this embodiment can be adjusted for efficient cleaning of the tank. The tank cleaning tool may be used any tank that must be cleaned of sludge, sediment, vegetative matter, or any type of debris. The tank cleaning tool of the present invention could be modified to accommodate any size tank, boiler, pipe or industrial application. Very less water is lost when replacing the drain valve or heating elements with the tank cleaning tool as the water supply to the tank has been turned off, the tank depressurized and vented.

It is to be understood that the above description is intended to be illustrative, and not restrictive. For example, the above discussed embodiments may be used in combination with each other. Many other embodiments will be apparent to those of skill in the art upon reviewing the above description.

Whereas, the construction and method have been described in relation to the FIGURES of the drawings, it should be understood that other and further modifications, apart from those shown or suggested herein, may be made within the spirit and scope of this invention.

What is claimed is:

1. A tank cleaning tool for cleaning sediments and debris out of a tank, the tool comprising:

a housing with an inlet end and an outlet end, said inlet end adapted to be connected to a drain hole of said tank to receive sediments and debris from said tank to form slurry in said housing, said outlet end adapted to discharge said slurry out of said tool;

a grinding chamber disposed between the inlet end and the outlet end of the housing;

an agitator extending from the inlet end, the agitator adapted to be inserted through the drain hole of said tank to agitate said sediments and debris inside said tank to pull said sediments and debris into said inlet end and into the housing when said agitator is spun inside said tank;

a shaft, extending through the grinding chamber and coupled to said agitator; and a shaft adaptor coupled to the shaft and extending from the housing near the outlet end and being adapted to connect said tool to a drill to spin said agitator.

2. The tool of claim 1, wherein said outlet end connects to a discharge hose to remove said slurry.

3. The tool of claim 1, wherein said outlet end includes threading to connect to a discharge hose to remove said slurry.

4. The tool of claim 1, wherein said outlet end includes a cap adapted to be opened to remove said slurry.

5. The tool of claim 1, wherein said outlet end includes a valve to regulate the discharge of the slurry out of the tool.

6. The tool of claim 1, wherein said inlet end includes a pipe nipple adapted to connect the inlet end of the tool to the drain hole of said tank.

7. The tool of claim 1, wherein said agitator is made of a drain cleaning snake.

8. The tool of claim 1, wherein said tool further includes an insert connected to an upper end of said agitator, said insert adapted to break up debris to loosen said debris.

9. The tool of claim 1, wherein said tool further includes an insert connected to an upper end of said agitator, said insert adapted to break up debris inside tank to loosen said debris, and wherein said insert is a weight.

10. The tool of claim 1, wherein said tool further includes an insert connected to an upper end of said agitator, said insert adapted to break up debris inside tank to loosen said debris, and wherein said insert is a brush.

11. The tool of claim 1, wherein said tool further includes an insert connected to an upper end of said agitator, said insert adapted to break up debris inside tank to loosen said debris, and wherein said insert is a cutter.

12. The tool of claim 1, wherein said tool further includes a straight shaft, an upper end of said straight shaft connected to the bottom end of said agitator and adapted to rotate off the center or wobble around in said tool as the shaft is spun from the jerky action of said agitator so as to bust up the debris inside said housing.

13. The tool of claim 1, wherein said tool further includes a bent shaft, an upper end of said bent shaft connected to the bottom end of said agitator and adapted to rotate off the center or wobble around in said tool as the shaft is spun from the jerky action of said agitator so as to bust up the debris inside said housing.

14. The tool of claim 1, wherein said tool further includes a motor and a timer for automated use.

15. The tool of claim 1, wherein said tank is a tank of a gas water heater.

16. The tool of claim 1, wherein said inlet end further includes a pipe nipple to connect said tool to the drain hole of a water heater.

17. A tank cleaning tool for cleaning sediments and debris out of a tank, the tool comprising: a housing with an inlet end and an outlet end, said inlet end adapted to be connected to a drain hole of said tank to receive sediments and debris from said tank to form slurry inside said housing, said outlet end adapted to discharge said slurry out of said tool;

an agitator extending from the inlet end, the agitator adapted to be inserted through the drain hole of said tank to agitate said sediments and debris inside said tank to pull said sediments and debris into said inlet end when said agitator is spun;

an auger connected to lower end of said agitator, said auger adapted to grind said received sediments and debris inside said housing to form slurry;

a shaft connected to said auger and extending through the housing; and a shaft adaptor present near the outlet end and adapted to connect said shaft to a drill to rotate said auger, wherein said auger spins said agitator.

18. The tank cleaning tool of claim 17, further comprising a grinding disk disposed in the housing, the grinding disk cooperating with the auger to grind the sediments and debris into a slurry to allow the slurry to discharge through the outlet end of the housing.

19. A tank cleaning tool for cleaning sediments and debris out of a tank, the tool comprising:

a housing with an inlet end and an outlet end, said inlet end adapted to be connected to drain hole of said tank to receive sediments and debris from said tank to form slurry inside said housing, said outlet end adapted to discharge said slurry out of said tool;

an agitator extending from the inlet end, the agitator adapted to be inserted through drain hole of said tank to agitate said sediments and debris inside said tank to pull said sediments and debris into said inlet end when said agitator is spun;

a grinding chamber between said outlet end and said inlet end, said grinding chamber adapted to grind said received sediments and debris inside said housing to form slurry;

an auger disposed within the grinding chamber and connected to a lower end of said agitator, said auger adapted to grind said received sediments and debris inside said grinding chamber to form slurry;

a shaft connected to said auger; and a shaft adaptor present near the outlet end and adapted to connect said shaft to a drill to rotate said auger, wherein said rotating auger spins said agitator.

20. The tank cleaning tool of claim 19, further comprising a grinding disk disposed in the grinding chamber, the grinding disk cooperating with the auger to grind the sediments and debris into a slurry to allow the slurry to discharge through the outlet end of the housing.

* * * * *